US006974785B1

(12) United States Patent
Barbeau et al.

(10) Patent No.: US 6,974,785 B1
(45) Date of Patent: Dec. 13, 2005

(54) OUTER SHELL FABRIC FOR FIRE PROTECTIVE GARMENTS FOR FIREFIGHTERS AND FOR WORKERS EXPOSED TO RISK OF FLASH FIRE OR ELECTRIC ARC

(75) Inventors: Claude Barbeau, St-Bruno (CA); Ross Cochran, Westmount (CA)

(73) Assignee: Bacou-Dailoz Protective Apparel, Montreal (CA)

( * ) Notice: Subject to any disclaimer, the term of this patent is extended or adjusted under 35 U.S.C. 154(b) by 0 days.

(21) Appl. No.: 09/517,323

(22) Filed: Mar. 2, 2000

(51) Int. Cl.[7] ..... D03D 15/00; D03D 15/12

(52) U.S. Cl. ..... 442/208; 442/213; 442/215; 442/301; 442/302; 442/209; 428/920; 428/921; 169/45; 169/46; 169/47; 169/48; 169/49; 169/50

(58) Field of Search ..... 169/45–50; 442/208, 442/209, 213, 215, 301, 302, 205–207; 428/920–921

(56) References Cited

U.S. PATENT DOCUMENTS 5,299,602 A 4/1994 Barbeau et al.
5,362,281 A * 11/1994 Dutton et al. ..... 474/205
5,527,597 A 6/1996 Stanhope et al.
5,624,738 A * 4/1997 Barbeau et al. ..... 428/198
5,928,971 A * 7/1999 Ellis et al. ..... 442/76

OTHER PUBLICATIONS

Marjory L. Smith, Introductory Textile Science 1986, CBS College Publishing, 5th Edition, pp. 235-236.*

* cited by examiner

*Primary Examiner*—Glenn Caidarola
*Assistant Examiner*—Alexis Wachtel
(74) *Attorney, Agent, or Firm*—Ogilvy Renault LLP

(57) ABSTRACT

The outer shell fabric according to the invention is made of a textile material which is a double-weave woven fabric or a warp-knit knitted fabric constructed in such a manner that preferably a majority of one yarn type is placed on the face of the fabric and the majority of a different yarn type is placed on the back surface. One of the yarns may consist of multi-filamentary meta-aramid fiber (e.g. Nomex), the other of either a multi-filamentary or a spun (staple) para-aramid fiber (e.g. Kevlar). The textile material can be visualized as two separate fabrics being interlaced together by the sharing of yarns between them. When used as part of a firefighter or work garment for protection against heat and flame, the outer shell fabric has superior tear resistance, abrasion resistance, UV resistance, and thermal protective performance when compared to other outer shell fabrics used for the same application. In addition, the textile material is more elastic than traditional woven fabrics of the same yarns, and when used in conjunction with a firefighter garment, increases comfort and mobility.

13 Claims, 3 Drawing Sheets

OUTER SHELL FABRIC FOR FIRE PROTECTIVE GARMENTS FOR FIREFIGHTERS AND FOR WORKERS EXPOSED TO RISK OF FLASH FIRE OR ELECTRIC ARC

BACKGROUND-OF THE INVENTION (a) Field of the Invention

This invention relates to textile material for use as the outer shell fabric of a firefighter garment. More particularly, the invention is concerned with a lightweight outer shell fabric that is constructed of two different homogeneous yarn types in such a way as to increase resistance to mechanical and UV degradation while increasing thermal protective performance. In addition, the textile material can stretch, thereby increasing comfort and mobility.

(b) Description of Prior Art

All fabrics used in the manufacture of protective clothing for firefighters must satisfy minimum performance requirements for flame, heat and tear resistance as prescribed by the National Fire Protection Agency (NFPA).

A firefighter garment is normally made of a composite layer of materials including an outer shell fabric. All fabrics currently used for the outer shell fabric of firefighter garments are woven. The warps and wefts of the outer shell fabric usually comprise spun yarns that are either made up of homogeneous fibers or intimate blends of different fibers. The purpose of using intimate blends of fibers in yarns is to combine the individual strengths of each of the constituent fibers. However, since each fiber has its own weaknesses as well as strengths, the resulting intimate blend yarn must necessarily have some performance compromises as well.

Many of the fibers used in the yarns used in outer shell fabric fabrics of firefighter garments have drawbacks: difficulty in absorbing dye stuffs, poor color retention, UV degradation, fibrillation, poor abrasion resistance.

The fabric may be constructed as a plain, ripstop, twill, herringbone or other traditional weave construction; it will however, appear as a continuous single sheet of yarns. And although there may be a face and a back surface to the weave construction, the face and back surfaces will consist of the identical yarns.

An alternative to spun yarns is multi-filamentary yarns. The latter have a much higher strength-to-weight and strength-to-denier ratios than the spun yarns of similar fibers. They are also more abrasion resistant and less water absorbing than spun yarns of the same fiber.

The principal disadvantages to multi-filamentary yarns are that the resulting fabrics are susceptible to yarn slippage.

The woven fabrics currently used as the outer shell fabric of fire protective garments, whether constituted of spun yarns, multi-filamentary or both, fray and ravel after being torn, cut or punctured. Fraying and raveling not only degrade the appearance of the garment, they make repairs more difficult, and they may increase the risk of injury to the firefighter wearing the garment.

U.S. Pat. No. 5,299,602 discloses an outer shell fabric wherein the textile material comprises warps of alternating multi-filamentary aramid yarns and wefts of alternating spun aramid and multi-filamentary aramid yarns in a twill weave. The object of the invention disclosed in that Patent was to increase firefighter comfort and mobility without reducing mechanical resistance. However, this fabric is still more vulnerable to yarn and seam slippage than fabrics made with 100% spun yarns. Also as a consequence of the high percentage of multi-filamentary yarns, the fabric ravels and frays when cut or torn. Furthermore, the fabric has a preponderance of KEVLAR® (aramid resin by DuPont) yarns on the face surface of the fabric and KEVLAR® is more subject to mechanical and ultraviolet (UV) degradation than either spun or multi-filamentary NOMEX® (yarns or threads of synthetic fibers by DuPont.

U.S. Pat. No. 5,527,597 discloses a woven firefighter fabric that incorporates a core-spun yarn (a LYCRA® (yarns or threads of synthetic fibers by DuPont) core protected by a polybenzimidazole/aramid wrap) to impart a degree of elasticity to the fabric. Although the Patent claims that the fabric maintains its elasticity after five minutes at 500° F., the literature reveals that LYCRA® is not thermally stable in firefighting environments: if stretched at temperatures above 370–390° F., LYCRA® will lose its elasticity; above 415° F., LYCRA® begins to char and lose its properties. Therefore, this stretchable fabric would suffer irreversible degradation in a firefighting environment.

It is therefore an object of the present invention to provide a stretchable fabric wherein the yarns such as aramid yarns would maintain their integrity at temperatures in excess of 600° F.

It is another object of the present invention to provide a textile material for the outer shell fabric of a firefighter garment that is lightweight yet has increased abrasion, tear, and UV resistance.

It is another object of the present invention to provide a textile material for the outer shell fabric of a firefighter garment that has a higher thermal protective performance rating than conventional fabrics of the same weight and fiber type.

It is another object of the present invention to achieve elasticity through the inherent stretchiness of a warp knit construction and not through the introduction of thermally unstable elastomers.

It is a further object of the present invention to provide a warp knit textile material that can be used to produce a firefighter outer shell fabric that is more resistant to fraying and raveling than the currently used woven fabrics.

SUMMARY OF THE INVENTION

In accordance with the present invention, there is provided a textile material to constitute an outer shell fabric for fire-resistive garments, the textile material being a textile arrangement of at least first and second inherently fire-resistant yarns, the first and second yarns being different from one another, the textile arrangement including interlacing means joining the first and second yarns.

Preferably, the textile arrangement is a warp knit or a double weave.

In accordance with a preferred embodiment, the first yarns are of first fiber type, and the second yarns are of a second fiber type which is different from the first fiber type.

The first yarns may be multi-filamentary yarns of the first fiber type and the second yarns may be spun yarns or multi-filamentary yarns of the second fiber type.

In accordance with another embodiment, the first yarns are exposed on a major part of a face of the outer shell fabric, and the second yarns are exposed on a major part of a back surface of the outer shell fabric. For example, the second yarns are exposed on less than about 15% of the face of the outer shell fabric, the first yarns are exposed on more than about 85% of the face of the outer shell fabric, and the second yarns are exposed on more than about 75% of the back surface of the outer shell fabric.

In accordance with yet another embodiment, the multi-filamentary yarns of the one fiber type are made up of one or more fibers selected from the group consisting of meta-aramid, para-aramid, polyimide, polybenzimidazole, polynosic rayon, polyimide-amide, polybenzoxazole, methacrylic and melamine fibers.

In accordance with another embodiment, the second yarns are spun yarns which are different from the first yarns and are made up of a fiber or a blend of fibers different from the multi-filamentary yarns.

In accordance with yet another embodiment, the second yarns are multi-filamentary yarns which are different from the first yarns and are made up of a fiber or a blend of fibers different from the multi-filamentary yarns of the first yarns. Preferably, the first yarn type consists of NOMEX® and the second yarn type consists of KEVLAR®.

The textile material according to the invention may comprise at least one additional and different yarn.

When the textile material according to the invention is a warp knit it may be produced by using two bars of different warp yarns on a Raschel machine.

The interlacing means may comprise warp yarns of the first type shared by both upper and bottom surfaces, or may comprise weft yarns of the first fiber type and shared by both upper and bottom surfaces, or may comprise warp and weft yarns of the first fiber type and shared by both upper and bottom surfaces. The interlacing means may comprise knitted loops of yarns.

When the textile arrangement is a double weave, the interlacing means may comprise an interlacing yarn which is common to both the upper and the bottom surfaces.

In accordance with another preferred embodiment, the first yarns are more dyeable, more resistant to UV degradation, and more resistant to fibrillation than the second yarns.

In accordance with a preferred embodiment of the invention, multi-filamentary yarns comprising fibers such as meta-aramid constitute greater than 85% of the yarns on the face surface of the textile material. Conversely, either spun or multi-filamentary yarns comprising fibers such as para-aramid form more than 75% of the yarns on the back surface of the textile material.

In one embodiment of the invention, a double-weave woven fabric, warp yarns in the face fabric will periodically drop down to become warp yarns in the back fabric. In this manner, the face and back fabrics are interlaced by having common warp yarns. In another embodiment of a double-weave fabric, the interlacing yarns may be weft (fill yarns). It would also be possible to provide interlacing common yarns in both the warp and the weft directions.

In another embodiment of the present invention, a warp-knit fabric, there are no weft yarns, only warp yarns. The warp yarns form continuously interlacing loops to make a length of fabric. In the warp-knit embodiment of the present invention multi-filamentary meta-aramid yarns are placed on one bar while spun or multi-filamentary para-aramid yarns are placed on a second bar. The loops of yarn from one bar are interlaced with loops of yarn from the other bar in a manner such that there is a preponderance of multi-filamentary meta-aramid yarn loops on the face surface and a preponderance of para-aramid spun or multi-filamentary yarn loops on the back surface.

BRIEF DESCRIPTION OF DRAWINGS

The invention is illustrated, but not restricted, by the annexed drawings of preferred embodiments in which.

DESCRIPTION OF PREFERRED EMBODIMENTS

Figure 1:
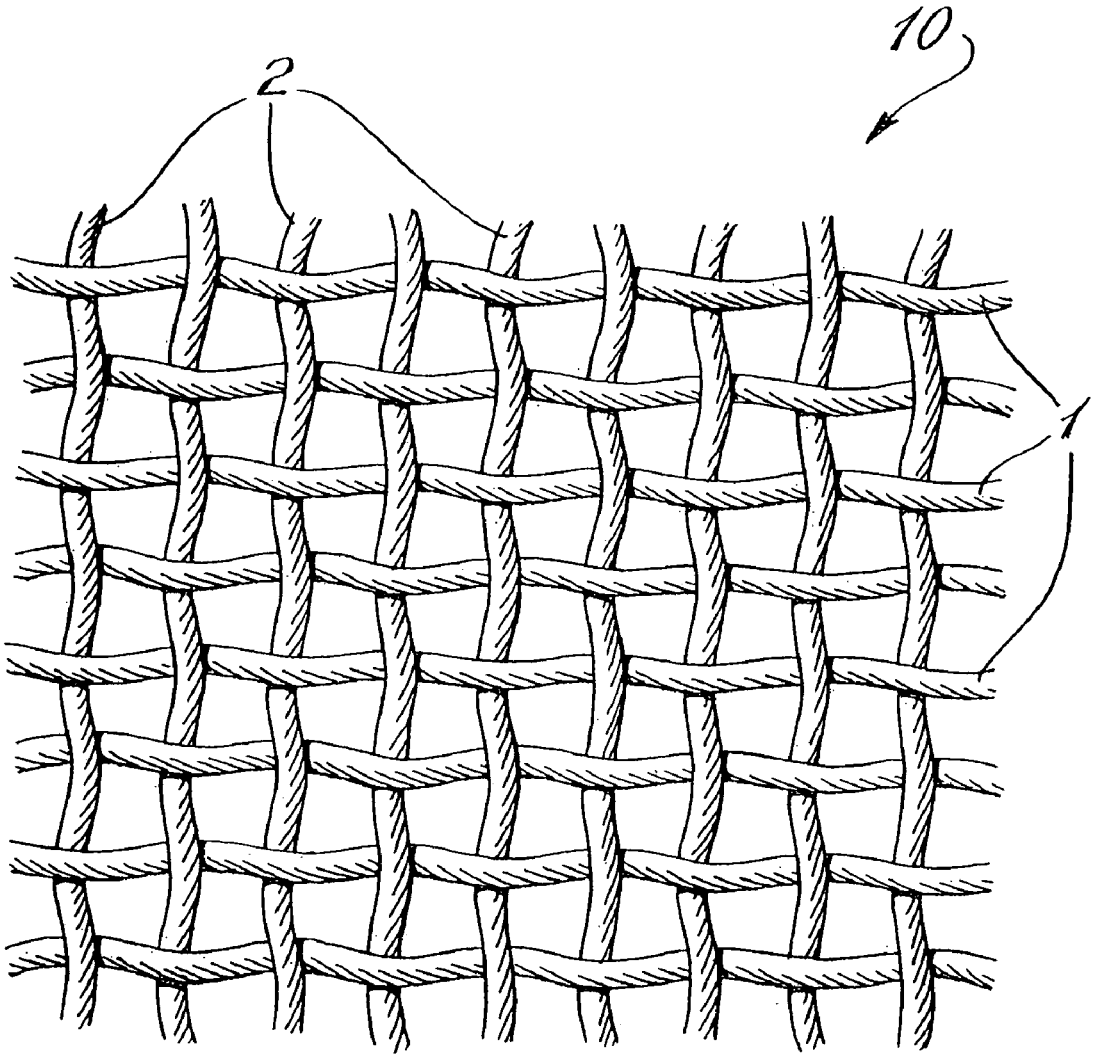
Fig. 1 Prior Art
FIG. 1 is an illustration in plan view on an enlarged scale of a conventional woven fabric of the prior art.

Referring to FIG. 1, it will be seen that in a conventional woven fabric 10, the warp yarns 2 and the weft yarns 1 are of the same type of yarns, for example spun yarns and are of the same fiber composition, such as aramid, or an intimate blend of the same fibers.

Figure 2:
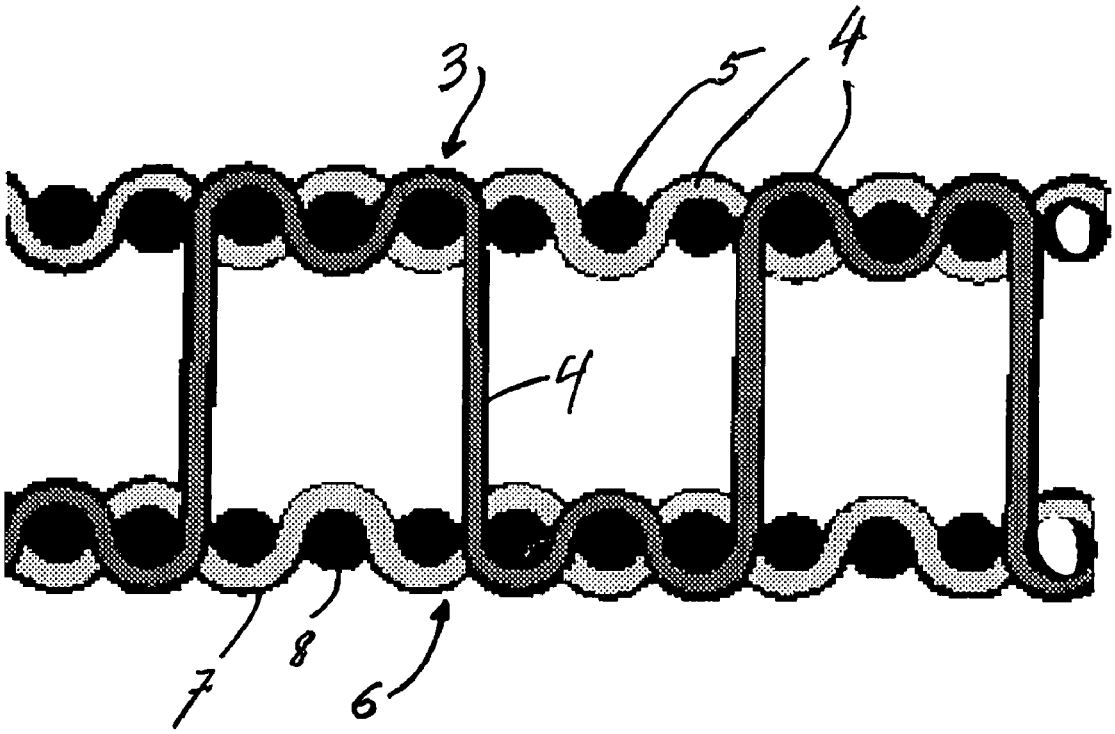
FIG. 2 is an illustration in edge view on an enlarged scale of a double-weave fabric according to the invention for the outer shell fabric of a firefighter garment.

Turning now to FIG. 2 which illustrates a double weave, the upper face 3 of the double weave consists of a warp of yarns 4 and a weft of yarns 5, here both NOMEX®, wherein N NOMEX® yarns 4 are predominantly exposed on upper surface 3. Bottom surface 6, on the other hand is a warp and weft weave of yarns 7 and 8, here both KEVLAR®, wherein KEVLAR® is predominantly exposed on bottom surface 6. The two weaves constituting upper surface 3 and bottom surface 6 are interlaced as shown by means of intermittent warp yarns 4 consisting of NOMEX®.

Figure 3:
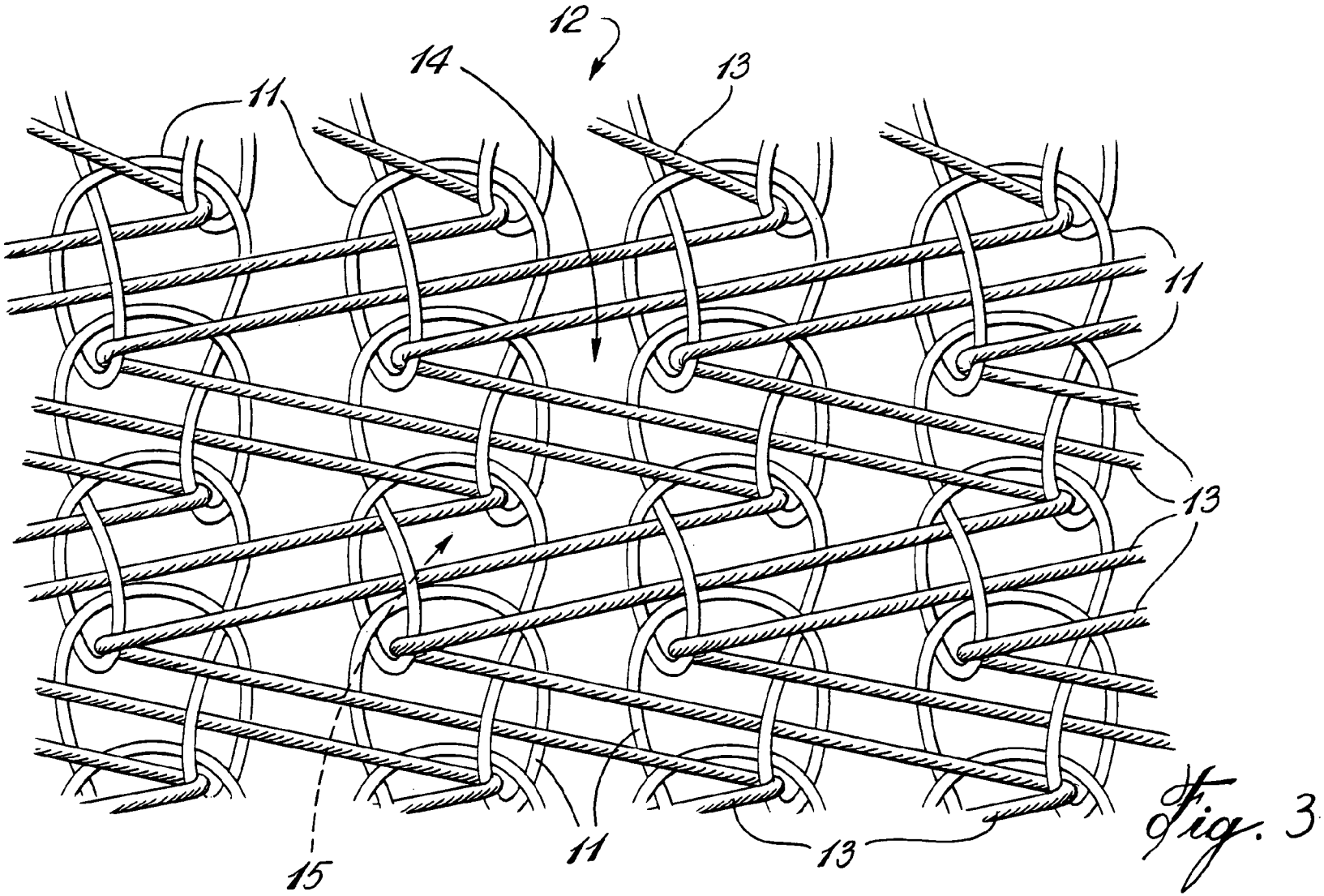
FIG. 3 is an illustration in plan view on an enlarged scale of the back surface of a warp knit fabric according to the invention.

Referring now to FIG. 3, the warp knit which is illustrated is a pillar stitch and cord stitch construction as commonly called in warp knit terminology. Warp knit yarns 11 forming the pillar stitch are multi-filamentary NOMEX® which are exposed on a major part of the face surface 15 of fabric 12, while warp knit yarns 13 are either spun or multi-filamentary KEVLAR® which are exposed on a major part of the back surface 14 of fabric 12.

It has been found that the textile material according to the invention whether of warp knit or double weave construction has more interstices than current woven outer shell fabrics. These interstices trap air which provides additional thermal insulation as measured by the Thermal Protective Performance (TPP) test of NFPA.

Furthermore, because the yarns used on the face (upper) and back (bottom) surfaces of the textile material are of different fiber types, the two surfaces react differently when exposed to heat fluxes in excess of 1.0 cal/cm$^2$/sec. The difference in reactions of the two surfaces causes the fabric to distort itself thereby creating an additional layer of insulating air.

It is understood that modifications are possible within the scope and spirit of the present invention as defined in the appended claims.

We claim:

1. A textile material to constitute an outer shell fabric for fire-resistive garments, said textile material being double weave having an upper surface and a bottom surface, said upper surface being defined by a first weave and said bottom surface being defined by a second weave, said first weave comprising an arrangement of a warp of yarns of a first fiber type material and a weft of yarns of said first fiber type material, wherein said yarns of said first fiber type material are arranged to be predominantly exposed on said upper surface, said second weave comprising an arrangement of a warp of yarns of a second fiber type material and a weft of yarns of said second fiber type material, wherein said yarns of said second fiber type material are predominantly exposed on said bottom surface, said first and second weaves being interlaced by means of intermittently arranged yarns of said first fiber type material, said intermittently arranged yarns sharing both said upper surface and said bottom surface, in a way that said yarns of said first fiber type material are exposed on a major part of said upper surface, and said yarns of said second fiber type material are exposed on a major part of said bottom surface.

2. Textile material according to claim 1, wherein said yarns of the first fiber type material are multi-filamentary yarns.

3. Textile material according to claim 2, wherein said yarns of the second fiber type material are spun yarns.

4. Textile material according to claim 2, wherein said yarns of the second fiber type material are multi-filamentary yarns.

5. Textile material according to claim 1, wherein said yarns of said second fiber type material are exposed on less than about 25% of said upper face, and said yarns of said first fiber type material are exposed on more than about 75% of said upper face.

6. Textile material according to claim 5, wherein said yarns of said second type material are exposed on more than about 75% of the bottom surface of said outer shell fabric.

7. Textile material according to claim 2, wherein said multi-filamentary yarns of said first fiber type material are made up of one or more fibers selected from the group consisting of meta-aramid, para-aramid, polyimide, polybenzimidazole, polynosic rayon, polyimide-amide, polybenzoxazone, methacrylic and melamine fibers.

8. Textile material according to claim 7 wherein said yarns of said second type material are spun yarns which are different from said yarns of said first type material and are made up of a fiber or blend of fibers selected from the group consisting of meta-aramid, para-aramid, polyimide, polybenzimidazole, polynosic rayon, polyimide-amide, polybenzoxazone, methacrylic and melamine fibers.

9. Textile material according to claim 7, wherein said yarns of said second fiber type material are multi-filamentary yarns which are different from said yarns of said first fiber type material and are made up of a fiber or blend of fibers selected from the group consisting of meta-aramid, para-aramid, polyimide, polybenzimidazole, polynosic rayon, polyimide-amide, polybenzoxazone, methacrylic and melamine fibers.

10. Textile material according to claim 1, wherein said yarns of said first fiber type material consists of NOMEX® yarns and said yarns of said second fiber type material consists of KEVLAR® yarns.

11. Textile material according to claim 1, wherein said interlacing yarns comprise weft yarns of the first fiber type material and shared by said first and said second weaves.

12. Textile material according to claim 1, wherein said interlacing yarns comprise warp yarns of the first fiber type material shared by said first first and said second weaves.

13. Textile material according to claim 1, wherein said interlacing yarns comprise warp and weft yarns of the first fiber type material shared by both said first and said second weaves.

* * * * *